US006926424B2

(12) United States Patent
Wu

(10) Patent No.: US 6,926,424 B2
(45) Date of Patent: Aug. 9, 2005

(54) RAPIDLY ASSEMBLED LAMP INSTALLATION DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 1 day.

(21) Appl. No.: 10/464,122

(22) Filed: Oct. 14, 2003

(65) Prior Publication Data

US 2005/0078479 A1 Apr. 14, 2005

(51) Int. Cl.[7] ..... H01R 33/00
(52) U.S. Cl. ..... 362/226; 362/260; 439/168
(58) Field of Search ..... 362/226, 217, 362/260, 285; 439/168, 620

(56) References Cited

U.S. PATENT DOCUMENTS 5,088,015 A * 2/1992 Baggio et al. ..... 362/217
5,727,869 A * 3/1998 Crosby et al. ..... 362/217
5,803,595 A * 9/1998 Verspaget et al. ..... 362/374
5,904,415 A * 5/1999 Robertson et al. ..... 362/260
6,582,102 B2 * 6/2003 Lin ..... 362/304

* cited by examiner

*Primary Examiner*—Ali Alavi

(57) ABSTRACT

A device for rapid installation of a lamp provides easy connection for a plurality of fluorescent tubes to a connecting box. Each of the fluorescent tubes is mounted into a base frame where a slide rod on a sliding track thereof secures the insertion of a fluorescent tube. As a fluorescent tube is inserted into the base frame, a slopped upper surface at the end thereof pushes the slide rod inward and upward. The slide rod, pushed by the fluorescent tube to the higher end of the sliding track, departs from a higher side of the slopped upper surface, slides back to the lower end of the sliding track, and thereby steadily holds the fluorescent tube. To unplug a fluorescent tube, the slide rod is pushed over the higher end of the sliding track so that the base frame and the fluorescent tube are unlocked.

2 Claims, 3 Drawing Sheets

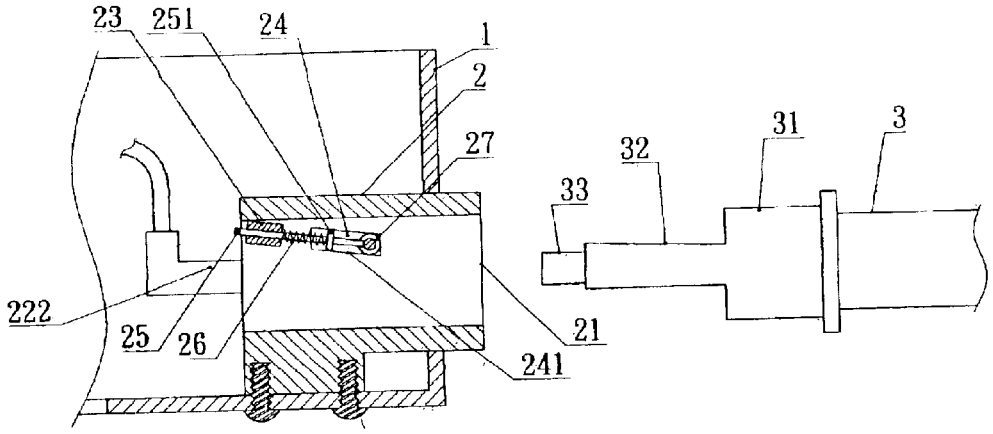
Fig. 3-A
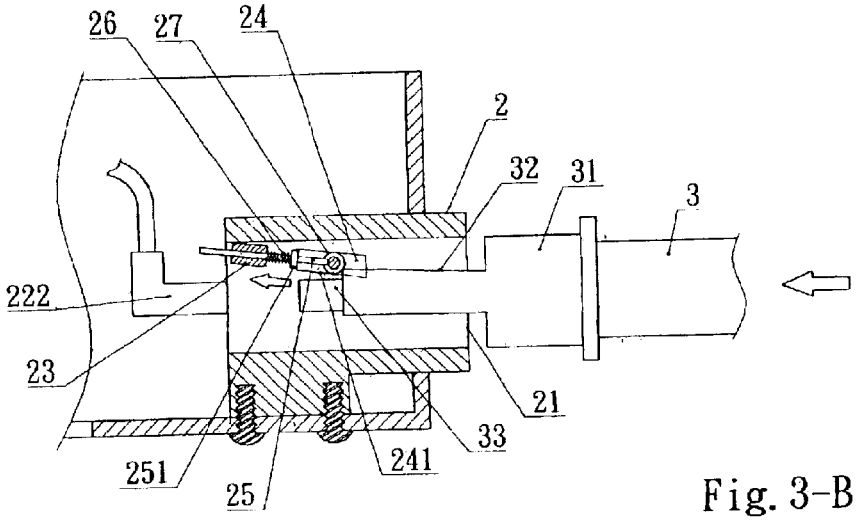
Fig. 3-B
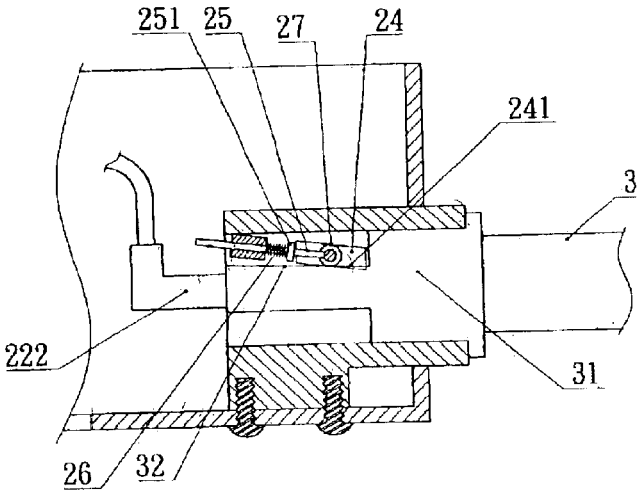
Fig. 3-C

RAPIDLY ASSEMBLED LAMP INSTALLATION DEVICE

FIELD OF THE INVENTION

The present invention relates to mechanisms for installation of a lamp, and more particularly to a mechanism for installation of a lamp which provides easy connection for a plurality of fluorescent tubes to a connecting box.

BACKGROUND OF THE INVENTION

It is straightforward to plug a fluorescent tube into a mechanism for installation of a lamp of the prior art, but since a typical mechanism of the prior art uses a spring plate to hook a bolt with a stopper therein. Using a tool to unplug a fluorescent tube is necessary, but it is inconvenient to a user. It is a further disadvantage that mechanisms of the prior art are complex and thus have more parts, which causes higher production cost and higher malfunction rate.

SUMMARY OF THE INVENTION

Accordingly, the primary object of the present invention is to provide simple and convenient mechanism for installation of a lamp. To achieve above objects, the present invention provides a locking mechanism between a fluorescent tube and a base frame, which is of simple structure and tool-free operation.

The various objects and advantages of the present invention will be more readily understood from the following detailed description when read in conjunction with the appended drawing.

BRIEF DESCRIPTION OF THE DRAWINGS

FIG. 3 is a side view of a preferred embodiment according to the present invention before (A), during (B), and after (C) a process of installation.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
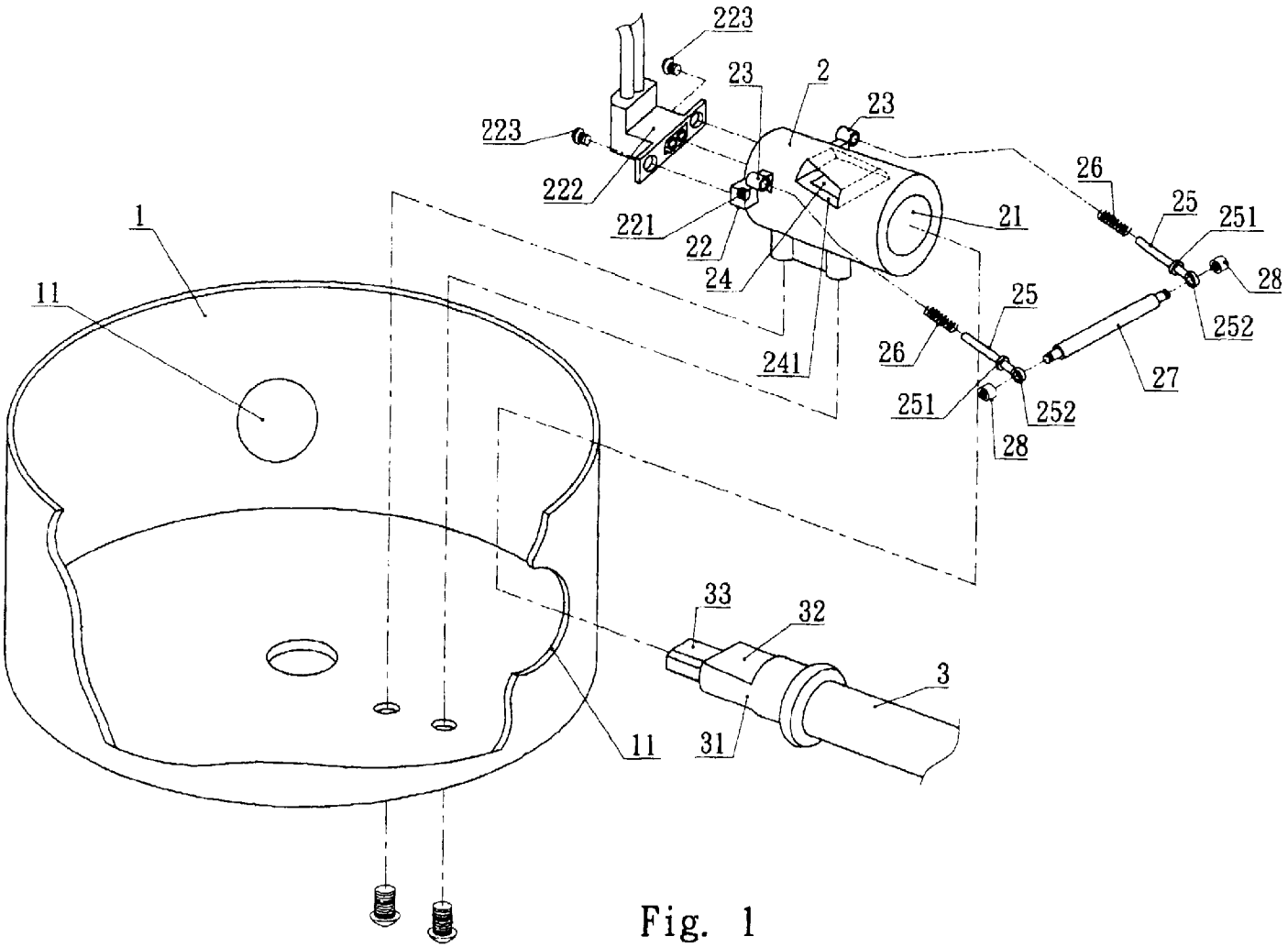
FIG. 1 is a perspective exploded view of a preferred embodiment according to the present invention.
Figure 2:
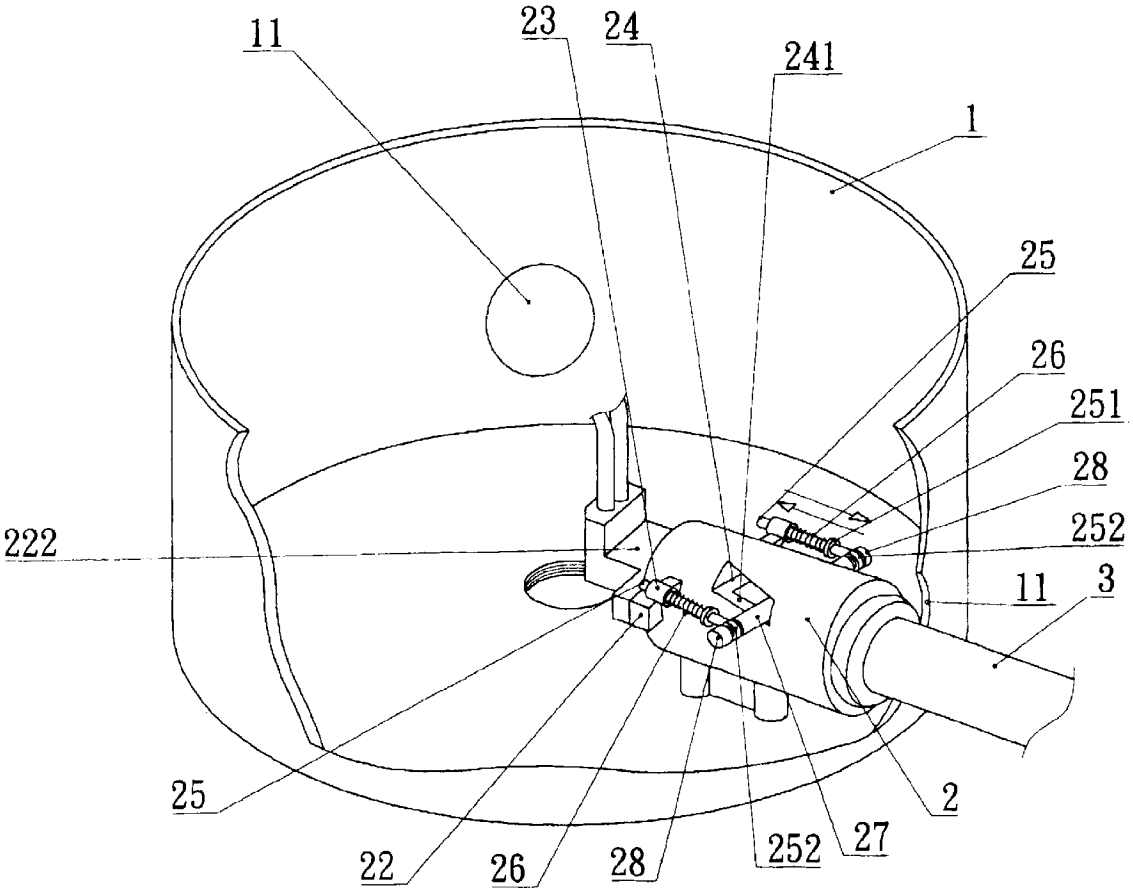
FIG. 2 is a perspective integral view of a preferred embodiment according to the present invention.

Referring to FIG. 1 and FIG. 2, a connection box 1 is generally a hollow cylindrical box having an open top, and a plurality of holes 11 is evenly formed on the circumference wall of the connection box 1. A base frame 2, which is generally a cylindrical tube, is mounted on the inner bottom surface of the connection box 1 with the front end thereof facing a hole 11. The inner channel of the base frame 2 defines an axial hole 21. A pair of fixing plates 22, each containing a tapped hole 221, is mounted on the outer wall at the rear end of the base frame 2 and on opposite sides. An insertion tube 23 is attached to each of the fixing plates 22 in a predetermined position. An electric socket 222 is mounted at the rear end of the base frame 2 at the center of the axial hole 21 by screwing the electric socket 222 and the fixing plates 22 together with screws 223. A sliding track 24 having a form of an elongated hole is formed by drilling through the upper half of the base frame 2 and extending across the wall area therein. The lower inner surface of the sliding track 24 defines a slope 241, and the sliding track 24 is tilted toward the front end of the base frame 2 so that the slope 241 extends downward into the axial hole 21 of the base frame 2. A pair of restricting rods 25 are attached to a base frame 2 respectively on both lateral sides of the sliding track 24. Each of the restricting rods 25 contains a blocking ring 251 and a connecting hole 252 and is inserted into the insertion tube 23 through a spring 26 so that the insertion tube 23 and the blocking ring 251 confine the spring 26. A slide rod 27 transversely goes through the sliding track 24 and pivotally connects the restricting rods 25 on both sides of the connecting holes 252. A pair of screw nuts 28 is used to lock two ends of the slide rod 27 at the connecting holes 252. Pushed by the springs 26, the slide rod 27 is stably situated at the lower end of the sliding track 24. Since the lower end of the sliding track 24 extends into the axial hole 21 of the base frame 2, the middle section of the slide rod 27 appears in the axial hole 21, which provides the necessary locking function. Further, an inserting portion 31 is integrally mounted at an end of a fluorescent tube 3, which has a slopped upper surface 32 and an electric plug 33 mounted at the end thereof. The inclination angle of the slopped upper surface 32 is nearly the same as that of the sliding track 24.

Referring to FIGS. 3A, B, and C, as the inserting portion 31 of the fluorescent tube 3 is inserted into the axial hole 21 of the base frame 2, the higher end of the slopped upper surface 32 pushes the slide rod 27 inward along the sliding track 24, and at the same time the slide rod 27 drives the restricting rods 25 inwards. Therefore the springs 26 are compressed. Because of the slope 241 of the sliding track 24, the slide rod 27 moves upward simultaneously, as shown in FIG. 3B. After being pushed by the slopped upper surface 32 to the higher end of the sliding track 24, the slide rod 27 is temporarily separated from the higher end of slopped upper surface 32 and driven by the springs 26 slides along the sliding track 24 back to the lower end thereof and presses the upper surface of the insertion portion 31 of the fluorescent tube 3 again. The slide rod 27 is therefore situated at the lower end of the slope 241 again. During this process of insertion, the slide rod 27 reacts back on the slopped upper surface 32, and thereby the inserting portion 31 moves steadily within the axial hole 21, which facilitates the insertion of the electric plug 33 into the electric socket 222 at the end of the axial hole 21, as shown in FIG. 3C. To unplug the fluorescent tube 3 from the base frame 2, the slide rod 27 is pushed inward to the higher end of the sliding track 24 so that the slide rod 27 passes over the higher end of the slopped upper surface at the inserted end of the fluorescent tube 3. The fluorescent tube 3 is then unlocked and can be easily taken from the base frame 2.

A preferred embodiment of the present invention as a mechanism for installation of a lamp is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rapidly assembled lamp installation device comprising:

a base frame having an axial hole and being attached with a pair of fixing plates; each fixing plate having a tapped hole and an insertion tube; a sliding track extending transversely through an upper wall of said base frame; a slope being formed on a lower inner surface of said sliding track and being tilted toward a front end of said base frame and extending into said axial hole;

a pair of restricting rods each including a blocking ring in a front section thereof and a connecting hole at one end thereof;

a pair of springs each slipped on said restricting rod and being confined by said insertion tube and said blocking ring;

an electric socket mounted to a rear end of said base frame at a center of said axial hole by screwing said electric socket and said fixing plates together;

a slide rod transversely passing through said sliding track and pivotally connecting said restricting rods at both ends of said slide rod through said connecting holes of said slide rod; said springs thereby pushing said slide rod so that said slide rod is stably situated at said lower end of said sliding track, wherein a middle section of said slide rod appears in said axial hole so as to provide a necessary locking function;

a fluorescent tube; an insertion portion extending from the fluorescent tube; a slopped upper surface being formed close to one end of said insertion portion having an inclination angle nearly the same as that of said sliding track; and an electric plug mounted at one end of said insertion portion of said fluorescent tube;

wherein when said fluorescent tube is inserted into said base frame through said axial hole, said slopped upper surface at one end of said fluorescent tube pushing said slide rod to move inward and upward along said sliding track; said slide rod at the same time driving said restricting rods inward and thereby compressing said springs; said slide rod departing from said slopped upper surface after reaching a higher end of said sliding track, and being driven back to said lower end of said sliding track by said springs, where said fluorescent tube is again stably held therein; to unplug said fluorescent tube, said slide rod being pushed inward to said higher end of said sliding track so that said slide rod striding over said higher end of said slopped upper surface of said insertion portion of said fluorescent tube; said fluorescent tube therefore being unlocked and easily removable.

2. The mechanism for installation of a lamp of claim 1, wherein a highest end of said slopped upper surface of said fluorescent tube is slightly lower than a highest end of said slope of said sliding track.

* * * * *